United States Patent [19]

Iio

[11] Patent Number: 4,943,216

[45] Date of Patent: Jul. 24, 1990

[54] SLIDING-VANE ROTARY COMPRESSOR

[75] Inventor: Masahiro Iio, Konan, Japan

[73] Assignee: Diesel Kiki Co., Ltd., Tokyo, Japan

[21] Appl. No.: 428,043

[22] Filed: Oct. 27, 1989

[30] Foreign Application Priority Data

Nov. 4, 1988 [JP] Japan ..... 63-278942

[51] Int. Cl.[5] ..... F04C 18/344

[52] U.S. Cl. ..... 418/15; 418/270

[58] Field of Search ..... 418/15, 259, 270

[56] References Cited

U.S. PATENT DOCUMENTS

| | | | |
|---|---|---|---|
| 4,389,170 | 6/1983 | Hayashi | 418/15 |
| 4,408,968 | 10/1983 | Inagaki | 418/15 |
| 4,619,595 | 10/1986 | Amano | 418/259 X |
| 4,668,172 | 5/1987 | Shibuya | 418/270 |
| 4,702,684 | 10/1987 | Takao | 418/259 |

FOREIGN PATENT DOCUMENTS

| | | | |
|---|---|---|---|
| 54986 | 5/1981 | Japan | 418/15 |

*Primary Examiner*—Michael Koczo
*Assistant Examiner*—Douglas J. Makosy
*Attorney, Agent, or Firm*—Wenderoth, Lind & Ponack

[57] ABSTRACT

A sliding-vane rotary compressor cylinder having a row of discharge holes arranged in an axial direction of the cylinder, and a corresponding number of discharge valves normally closing the respective discharge holes. The opening of two endmost discharge valves is limited by a first valve-opening limiting device to a first value. The opening of the remaining discharge valves is limited by a second valve-opening limiting device to a predetermined value which is larger than the first value. With this construction, the a rotor rotatably received in the cylinder is stably held in position against axial displacement or oscillation.

6 Claims, 3 Drawing Sheets

SLIDING-VANE ROTARY COMPRESSOR

BACKGROUND OF THE INVENTION

1. Field of the Invention

The present invention relates to a sliding-vane rotary compressor for compressing a refrigeration medium or the like.

2. Description of the Prior Art

Sliding-vane rotary compressors, as disclosed for example in Japanese Utility Model Laid-open Publication No. 61-92778, include a compressor body composed of a cylinder block having an inside guide surface of an appropriate configuration, and front and rear side blocks disposed on opposite ends of the cylinder block, and a rotor rotatably disposed in the compressor body and carrying thereon a plurality of radially movable sliding vanes held in contact with the guide surface of the cylinder block.

The rotor is concentrically and fixedly mounted on a drive shaft which is rotatably supported on the front and rear side blocks via a pair of bearings, with an appropriate clearance between each respective side block and the rotor for smooth rotation of the rotor. The vanes, rotor, cylinder block and front and rear side blocks jointly define therebetween a plurality of compression chambers in which a refrigeration medium is compressed.

The drive shaft has a front side end operatively connected with an electromagnetic clutch for receiving a rotational power or torque via the electromagnetic clutch. When the electromagnetic clutch is energized, a clutch plate is pulled or attracted to the rotor so that a drive force is transmitted to the drive shaft, thereby rotating the rotor of the rotary compressor. With rotation of the rotor, the vanes slide along the guide surface of the cylinder block to cause the compression chambers to be subsequently increased and decreased in volume with each revolution of the rotor, whereby the refrigeration medium drawn into the compression chamber is compressed, then discharged therefrom through discharge holes by forcibly opening reed valves associated with the respective discharge holes.

The conventional sliding-vane rotary compressors of the foregoing construction have a problem that an unpleasant noise is produced while the compressor is operating. More specifically, in a sliding-vane rotary compressor having a total of five sliding vanes, the torque fluctuation occurs ten times per a single revolution of the rotor while the load fluctuation occurs five times per a single revolution of the rotor. Such torque and load fluctuations produce a higher harmonic resonance of the rotor which in turn brings about resonant vibration of other components. Thus, an unpleasant operation noise is produced from the rotary compressor.

The unpleasant noise is caused by the presence of a clearance which is provided between the front side block and the rotor and also between the rotor and the rear side block for enabling a smooth rotation of the rotor. With the clearance thus provided, the rotor is caused to oscillate in the axial direction when subjected to periodical forcers produced in response to the fluctuation of load on the rotor.

SUMMARY OF THE INVENTION

With the foregoing difficulties in view, it is an object of the present invention to provide a sliding-vane rotary compressor incorporating structural features which are capable of controlling or limiting undesired oscillation of a rotor resulting from the fluctuation of torque and load caused by periodical compression work, thereby enabling silent operation of the compressor.

According to the present invention, there is provided a sliding-vane rotary compressor comprising: a compressor body composed of a cylinder and a pair of side blocks attached to opposite ends of the cylinder; a rotor rotatably disposed in the compressor body and carrying thereon a plurality of radially movable sliding vanes, there being defined between the cylinder, rotor and vanes a plurality of compression chambers which vary in volume with each revolution of said rotor; a plurality of discharge holes formed in the cylinder and arranged in a direction parallel to a longitudinal axis of the cylinder; a plurality of discharge valves disposed on the cylinder and normally closing the discharge opening, respectively, the discharge valves being displaceable to open the corresponding discharge openings when they are forced to open by a compressed fluid, thereby permitting a compressed fluid to flow out from the compression chambers; first valve-opening limiting means for limiting the opening of at least two endmost ones of the discharge valves to a first predetermined value; and second valve-opening limiting means for limiting the opening of the discharge valves other than the two endmost discharge valves to a second predetermined value larger than the first predetermined value.

With this construction, since the two endmost discharge valves disposed adjacent to the front and rear side blocks have a smaller opening than the remaining discharge valves, the pressure distribution in the compression chambers becomes greater at opposite sides than at the central portion of the rotor. Accordingly, the pressure acting in a clearance provided between the front side block and the rotor and also between the rotor and the rear side block is increased, so that the rotor is pneumatically compressed and hence held in position against axial displacement or oscillation. Thus, the sliding-vane compressor operates silently without producing an unpleasant noise.

The above and other objects, features and advantages of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

The present invention will be described hereinbelow in greater detail with reference to certain preferred embodiments shown in the accompanying drawings.

Figure 4:
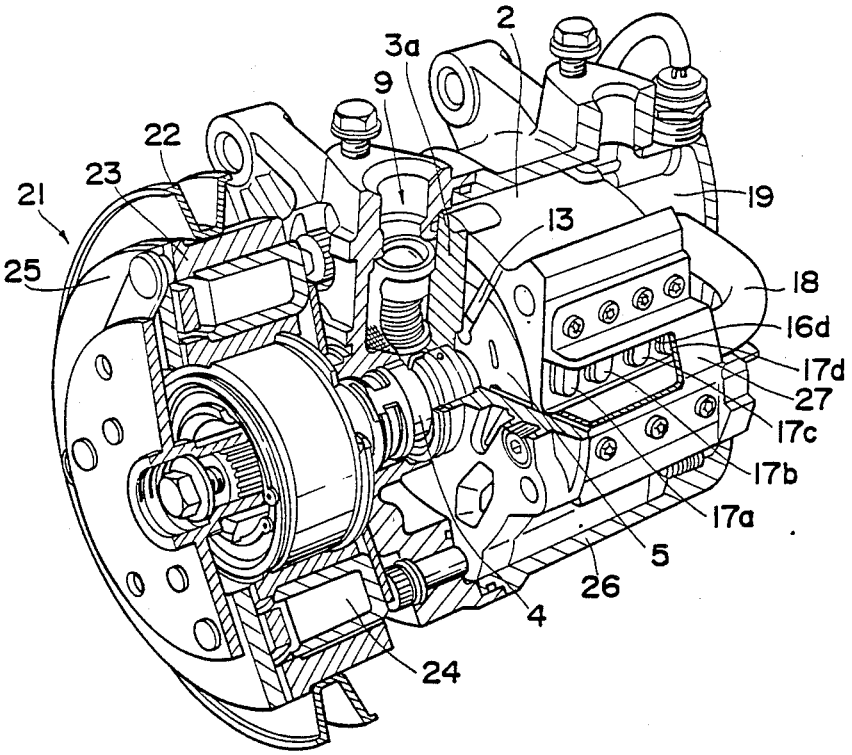
FIG. 4 is a perspective view, with parts cutaway for clarity, of a sliding-vane rotary compressor according to the present invention.
Figure 5:
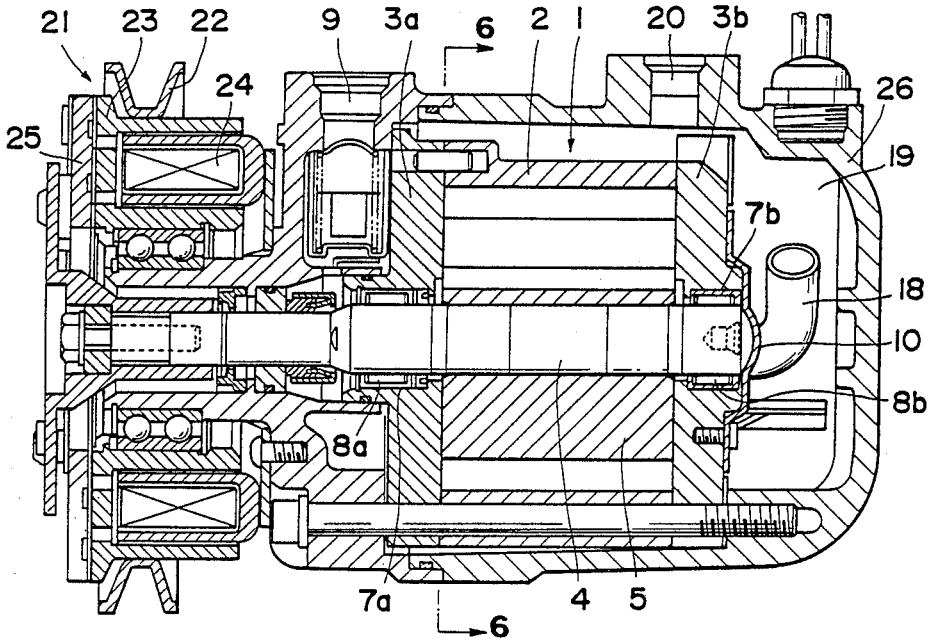
FIG. 5 is a cross-sectional view of the sliding-vane rotary compressor shown in FIG. 4.
Figure 6:
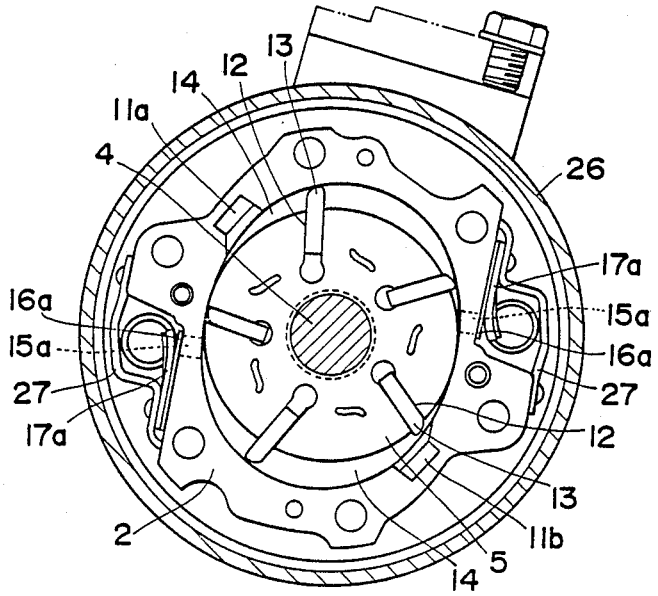
FIG. 6 is a cross-sectional view taken along line 6—6 of FIG. 5.

As shown in FIGS. 4 through 6, a sliding-vane rotary compressor embodying the present invention generally includes a body 1 composed of a cylinder 2 having an inside guide surface of a desired configuration, and front and rear side blocks 3*a* and 3*b* secured to opposite ends of the cylinder 2. The compressor further includes a cylindrical rotor 5 concentrically and fixedly mounted on a drive shaft 4 and rotatably received in a compressor body 1, with diametrically opposite portions of the rotor 5 confronting the inside guide surface of the cylinder 2 with an appropriate clearance defined therebetween. The drive shaft 4 is rotatably supported on a pair of bearings 8*a*, 8*b* fitted respectively in a pair of aligned axial holes 7*a*, 7*b* formed respectively in the front side block 3*a* and the rear side block 3*b*. The drive shaft 4 is connected at its one end to an electromagnetic clutch 21 for connection with a driving source (not shown), the other end of the drive shaft 4 being received within the axial hole 7*b* in the rear side block 3*b*. The hole 7*b* is blocked from fluid communication with a high pressure chamber 19 by means of a cover 10 secured to an outer end face of the rear side block 3*b*.

The electromagnetic clutch 21 includes a circular ring-shaped rotor 23 having an integral V-pulley 22, an electromagnet 24 mounted on the rotor 23 for magnetizing the same, and a clutch plate 25 disposed in confrontation to the rotor 23 and coupled with the one end of the drive shaft 4. The rotor 23 is rotated by the non-illustrated driving source such as an engine via an endless belt extending around the V-pulley 22 and a drive pulley of the driving source. When the electromagnet 24 is supplied with an exciting current, the electromagnetic clutch 21 is energized whereupon the rotor 23 being driven by the drive source is magnetized by the electromagnet 24. Thus, the clutch plate 25 is attracted to the rotor 23 and hence rotated in unison with the rotor 23, thereby transmitting a rotational driving power to the drive shaft 4 of the rotary compressor.

Figure 1:
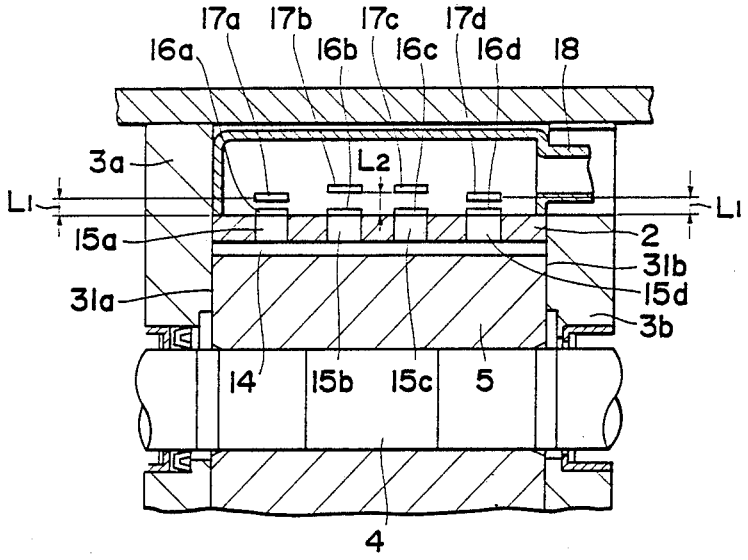
FIG. 1 is a fragmentary cross-sectional view of a portion of a sliding-vane rotary compressor according to the present invention, showing an arrangement of discharge holes.

The rotor 5 has a plurality of substantially radially extending grooves 12 (FIG. 6) in which a corresponding number of sliding vanes 13 are movably received. While the compressor is operating, the vanes 13 slide along the inside guide surface of the cylinder 2 as they are forced outwardly in contact with the inside guide surface of the cylinder 2 by a back pressure produced behind the respective vanes 13 and also by a centrifugal force produced by high-speed rotation of the rotor 5. When each vane 13 passes through a pair of intake holes 11*a* or 11*b* (described later) formed in the cylinder 2, a refrigeration medium is drawn into a compression chamber 14 defined jointly between the vane 13 and a succeeding vane 13, then trapped in the compression chamber 14. A plurality of such compression chambers 14 are defined between the adjacent vanes 13, rotor 5, cylinder 2 and front and rear side blocks 3*a*, 3*b*. The compression chambers 14 vary in volume progressively from a minimum value to a maximum value during the intake stroke. Conversely, during the discharge stroke, the volume of the compression chambers 14 progressively varies from the maximum to the minimum. The compressed refrigeration medium is discharged from a plurality of discharge holes 15*a*–15*d* which are formed in the cylinder 2 and arranged in a direction parallel to a longitudinal axis of the cylinder 2, as shown in FIG. 1.

The row of discharge holes 15*a*–15*d* are disposed in diametrically opposite relation to another row of discharge holes 15*a*–15*d*, as seen from FIG. 6. Likewise, one pair of the intake holes 11*a*, 11*a* is disposed in diametrically opposite relation to another pair of the intake holes 11*b*, 11*b*.

Figure 2:
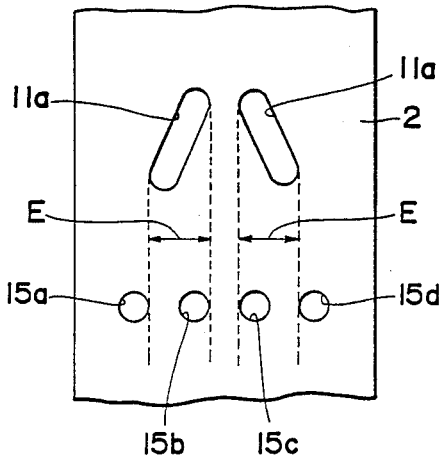
FIG. 2 is a fragmentary plan view of a cylinder of the rotary compressor, showing an arrangement of the discharge holes and intake holes.

As shown in FIG. 2, the intake holes 11*a*, 11*a* and the row of discharge holes 15*a*–15*d* are circumferentially spaced from one another. The intake holes 11*a*, 11*a*comprise oblong holes disposed in side-by-side juxtaposition but extend at an angle to each other so that a major axis of each oblong intake hole 11*a*, 11*a* extend at an angle to the longitudinal axis of the cylinder 2. More specifically, the oblong intake holes 11*a*, 11*a* extend divergently toward the discharge holes 15*a*–15*d* such that a minimum distance between the intake holes 11*a*, 11*b* is the same as or slightly smaller than the distance between the discharge holes 15*b*, 15*c* disposed between two endmost discharge holes 15*a*, 15*d*, and a maximum distance between the intake holes 11*a*, 11*b* is the same as or slightly smaller the distance between the endmost discharge openings 15*a*, 15*d*. The divergently arranged oblong intake holes 11*a*, 11*b* each have an effective width E much larger than the diameter of the discharge holes 15*b*, 15*c* but they are disposed generally in circumferentially aligned relation to the corresponding ones of the discharge holes 15*a*–15*d*. This circumferentially aligned arrangement is particularly effective to rectify the flow of the refrigeration medium during the intake and discharge strokes.

Figure 3:
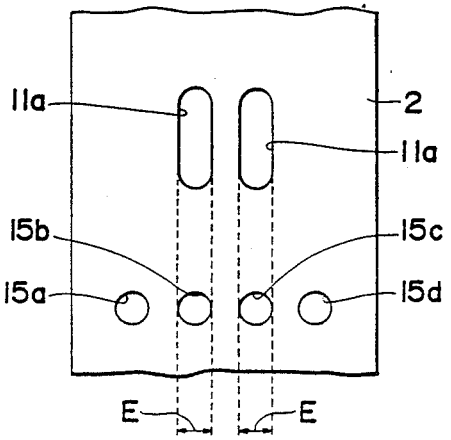
FIG. 3 is a view similar to FIG. 1, but showing an arrangement of the discharge holes and the intake holes according to an another embodiment.

FIG. 3 shows a modified arrangement of the intake holes 11*a*, 11*a* and the discharge holes 15*a*–15*d* according to the present invention. The intake holes 11*a*, 11*a* comprise a pair of parallel spaced oblong holes whole major axis extend perpendicularly to the longitudinal axis of the cylinder 2. The oblong intake holes 11*a*, 11*a* are circumferentially aligned with the discharge holes 15*b*, 15*c*, respectively. With this aligned arrangement, the refrigeration medium is rectified as it flows through the intake and discharge holes 11*a*, 11*a*; 15*a*–15*d* during the intake and discharge strokes.

During the discharge stroke, a plurality of discharge valves 16*a*–16*d* associated with the respective discharge holes 15*a*–15*d* are forced to open by the compressed refrigeration medium. The intake and discharge strokes are repeated to compress the refrigeration medium in the compression chambers 14 and then discharge the compressed refrigeration medium from the compression chambers 14 via the discharge valves 16*a*–16*d*. The compressed refrigeration medium discharged by the discharge valves 16*a*–16*d* is guided by a discharge pipe 18 to flow into a high pressure chamber 19 defined in the shell 26 from which the compressed refrigeration medium is delivered from an outlet 20 to the outside of the rotary compressor. Designated by 9 is an inlet through which the refrigeration medium is supplied to the rotary compressor.

The discharge valves 16*a*–16*d* correspond in number to the number of the discharge holes 15*a*–15*d* (four in the illustrated embodiment) comprise reed valves normally closing the corresponding discharge holes 15*a*–15*d*. The reed valves 16*a*–16*d* are displaceable to open the corresponding discharge holes 15*a*–15*d* when they are forced outwardly by the compressed refrigeration medium. The displacements of the respective reed valves 16*a*–16*d* are limited by valve stoppers or retainer 17*a*–17*d* (FIGS. 1 and 6) secured to the cylinder 2 adjacent to the corresponding reed valves 16*a*–16*d* and engageable with the reed valves 16*a*–16*d*.

As shown in FIG. 1, the valve stoppers 17*a*–17*d* are spaced from the reed valves 16*a*–16*d*. More specifically, two valve stoppers 17*a* and 17*d* corresponding in position to the position to the two endmost reed valves 16*a* and 16*d* are spaced from the two reed valves 16*a*, 16*d* to such an extent that the reed valves 16*a*, 16*d* are outwardly displaceable by a first distance L1 substantially equal to 0.2 mm, for example. On the other hand, the remaining valve stoppers 17*b* and 17*c* are spaced from the reed valves 16*b*, 16*c* to such an extent that the reed valves 16*b*, 16*c* are outwardly displaceable by a second distance L2 which is larger than the first distance L1 such as about 0.8 mm.

Since the opening of each individual discharge hole 15*a*–15*d* is determined by the displacement of a corresponding one of the reed valves 16*a*–16*d* (i.e., the opening of each reed valve), the flow rate of the compressed refrigeration medium from the discharge holes 15*a*–15*d* varies with the extent of displacement of the reed valves 16*a*–16*d*. In the illustrated embodiment, the flow rate of the compressed refrigeration medium from the compression chambers 14 is smaller at the opposite sides adjacent to the front and rear side blocks 3*a*, 3*b* than at the central portion so that the opposite sides are kept at a higher pressure than the central portion. Accordingly, the compressed refrigeration medium flowing into a clearance 31*a* between the front side block 3*a* and the rotor 5 and also into a clearance 31*b* between the rear side block 3*b* and the rotor 5 compressed the rotor 5 from the opposite directions. Thus, the rotor 5 is pneumatically retained in position against axial displacement or oscillation with the result that the rotary compressor can be driven silently without generating an unpleasant oscillating noise.

As shown in FIG. 6, the discharge valves 16*a*–16*d* and the valve stoppers 17*a*–17*d* are covered by a pair of cover members 27. The cover members 27 are formed of a material having vibration damping characteristic so as to reduce a noise level resulting from vibrations. An appropriate vibration damping material includes non-constrained Fe - Cr (iron - chromium) alloys. The Fe - Cr alloys have a vibration damping capacity of $40\text{–}60\times10^{-3}$ which is 10 to 30 times as large as the damping capacity of aluminum alloys ($2\times10^{-3}$), a stainless alloy SUS 304 ($3\times10^{-3}$) and steels ($4\times10^{-3}$). With the damping cover members 27 thus provided, a further reduction of the operation noise of the rotary compressor is achieved.

Obviously, various modifications and variations of the present invention are possible in the light of the above teaching. It is therefore to be understood that within the scope of the appended claims the present invention may be practiced otherwise than as specifically described.

What is claimed is:

1. A sliding-vane rotary compressor comprising:

(a) a compressor body composed of a cylinder and a pair of side blocks attached to opposite ends of said cylinder;

(b) a rotor rotatably disposed in said compressor body and carrying thereon a plurality of radially movable sliding vanes, there being defined between said cylinder, rotor and vanes a plurality of compression chambers which vary in volume with each revolution of said rotor;

(c) a plurality of discharge holes formed in said cylinder and arranged in a direction parallel to a longitudinal axis of said cylinder;

(d) a plurality of discharge valves disposed on said cylinder and normally closing said discharge opening, respectively, said discharge valves being displaceable to open the corresponding discharge openings when they are forced to open by a compressed fluid, thereby permitting a compressed fluid to flow out from said compression chambers;

(e) first valve-opening limiting means for limiting the opening of at least two endmost ones of said discharge valves to a first predetermined value; and (f) second valve-opening limiting means for limiting the opening of the remaining discharge valves to a second predetermined value larger than said first predetermined value.

2. A sliding-vane rotary compressor according to claim 1, wherein said cylinder has two pairs of juxtaposed oblong intake holes disposed in diametrically opposite relation to one another, each said oblong intake hole having a major axis extending perpendicular to said longitudinal axis of said cylinder, said oblong intake hole being aligned with one of said discharge opening in a circumferential direction of said cylinder.

3. A sliding-vane rotary compressor according to claim 1, wherein said cylinder has two pairs of juxtaposed oblong intake holes disposed in diametrically opposite relation to one another, each said oblong intake hole extending obliquely with respect to said longitudinal axis of said cylinder, said oblique, oblong intake hole being substantially aligned with one of said discharge holes in a circumferential direction of said cylinders and having an effective with greater than said one discharge hole.

4. A sliding-vane rotary compressor according to claim 3, wherein the two juxtaposed oblong intake holes of each intake hole pair extend divergently toward said discharge holes.

5. A sliding-vane rotary compressor according to claim 1, wherein said first valve-opening limiting means comprises a plurality of valve stoppers secured to said cylinder adjacent to said two endmost discharge valves and engageable with said two endmost discharge valves to limit the opening of the discharge valves when the compressed fluid is discharged.

6. A sliding-vane rotary compressor according to claim 1, wherein said second valve-opening limiting means comprises a plurality of valve stoppers secured to said cylinder adjacent to said remaining discharge valves and engageable with said remaining discharge valves to limit the opening of said remaining discharge valves.

* * * * *